United States Patent [19]

Sherrill

[11] Patent Number: 4,460,022

[45] Date of Patent: Jul. 17, 1984

[54] WARP STOP MOTION WITH CONTROL BAR

[76] Inventor: John B. Sherrill, P.O. Box 578, Gastonia, N.C. 28052

[21] Appl. No.: 383,029

[22] Filed: May 28, 1982

Related U.S. Application Data

[63] Continuation-in-part of Ser. No. 129,105, Mar. 10, 1980, Pat. No. 4,338,972.

[51] Int. Cl.[3] ..... D03D 51/28

[52] U.S. Cl. ..... 139/369

[58] Field of Search ..... 139/358, 369

[56] References Cited

U.S. PATENT DOCUMENTS 671,203 4/1901 Baker et al. ..... 139/358

3,584,659 6/1971 Pfarrwaller ..... 139/369

*Primary Examiner*—Henry Jaudon

*Attorney, Agent, or Firm*—Clifton Ted Hunt

[57] ABSTRACT

A warp stop-motion mechanism including a plurality of electrodes and means supporting the electrodes in a common plane. A drop wire is provided for each warp yarn and the warp yarns support the drop wires about the electrodes in normal operation. A control bar is provided at a lower elevation than the electrodes and is in continuous engagement with the warp yarns during normal operation of the loom to prevent repetitive contact of the electrodes by the warp yarns and drop wires. Means are provided for adjusting the warp stop-motion mechanism longitudinally, transversely, and vertically.

5 Claims, 8 Drawing Figures

FIG. 1
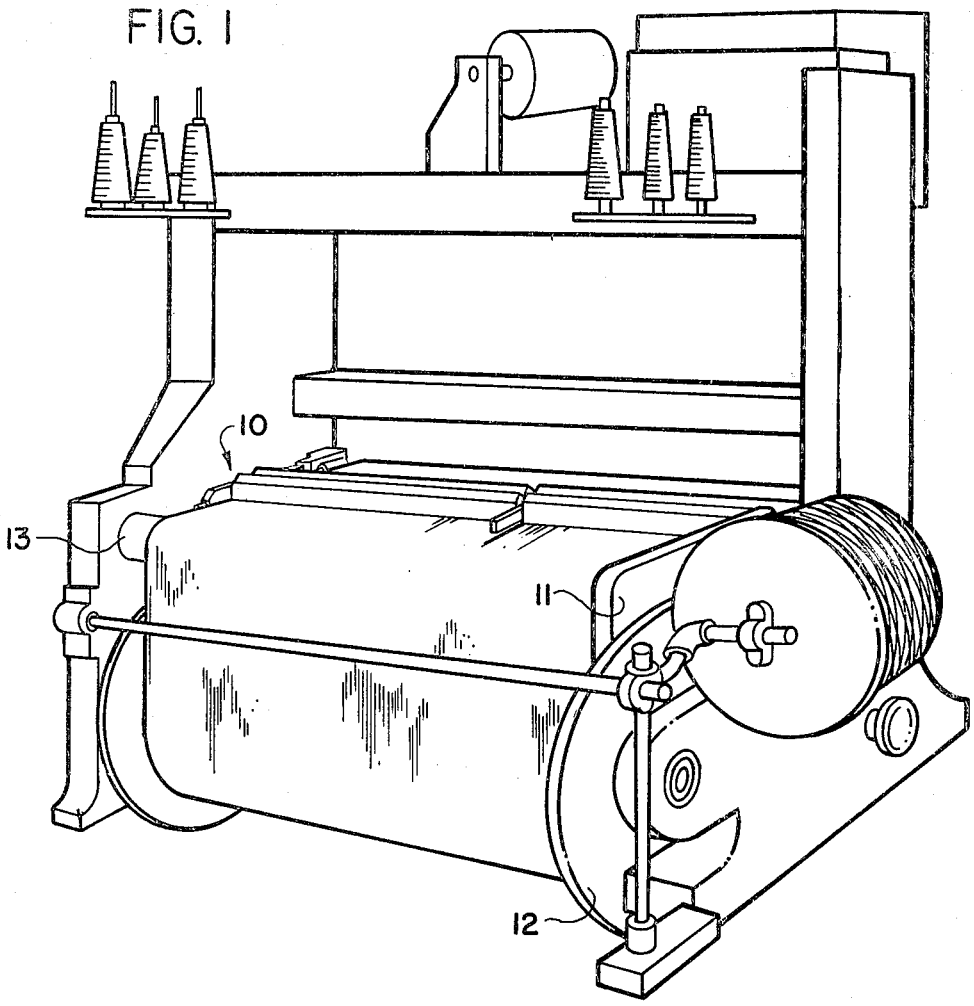
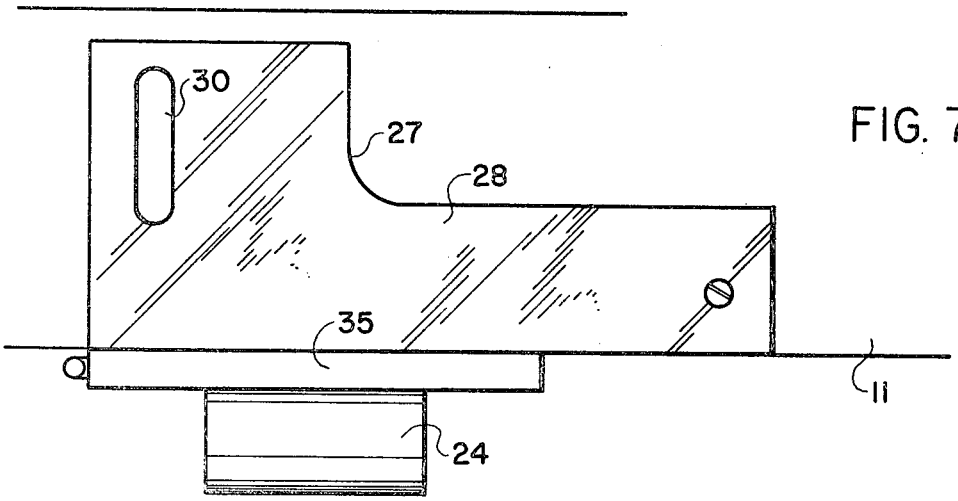
FIG. 7

WARP STOP MOTION WITH CONTROL BAR

CROSS REFERENCE TO RELATED APPLICATION

This application is a continuation-in-part of application Ser. No. 129,105 filed Mar. 10, 1980, now U.S. Pat. No. 4,338,972, and entitled PIVOTAL SUPPORT WITH POSITIVE STOP FOR WARP STOP-MOTION.

BACKGROUND OF THE INVENTION

Electric warp stop-motions using drop wires and electrodes have long been known. Their function is to stop the loom when a warp thread breaks. After leaving the warp beam, each thread passes over a whip roll and through one of a plurality of drop wires, there being a drop wire provided for each warp thread. The warp thread passing through a drop wire supports the drop wire above an electrode in assembled relation. The warp threads pass from the stop-motion mechanism through the heddle of a loom which rapidly and repetitively selectively raises and lowers the warp threads to form a shed for passage of the shuttle during the weaving operation. The rapid and repetitive raising and lowering of the warp threads by the heddle causes the warp threads to continuously beat against the electrodes in the conventional stop-motion mechanisms and the repetitive engagement of the electrodes by the warp threads, particularly strong and abrasive filaments such as polyester and glass result in nicking and scratching of the electrodes. The nicking and scratching of the electrodes is undesirable because contact of the warp threads with a roughened surface results in yarn breakage and consequent down-time and production.

It is well known that the positioning of the warp stop-motion device is critical to the grain or the appearance of the fabric. Said prior patent application Ser. No. 129,105 recognizes the importance of providing means for rapidly and accurately shifting or adjusting the stop-motion mechanism longitudinally and laterally of the loom, and vertically, as desired. The present application incorporates the advantages of the prior application and includes means for protecting the electrodes from damage by the drop wires and additional improved means for making quick and effective adjustment of the stop-motion mechanism.

SUMMARY OF THE INVENTION

The present invention incorporates a control bar in the stop-motion mechanism to limit vertical movement of the warp threads within the stop-motion mechanism and prevent their engagement with the electrodes, thereby preventing the electrodes from being abraded and contributing to the useful life of the electrodes, and preventing yarn breakage and down-time of the loom.

The present invention also includes improved means for rapidly and reliably relocating the stop-motion mechanism to accomodate the requirements for weaving with different yarns.

BRIEF DESCRIPTION OF THE DRAWINGS

FIG. 1 is a perspective view looking at the rear of a loom and illustrating the relative positioning of the warp stop-motion mechanism and the warp beam;

FIG. 7 is a top plan view of the mounting bracket illustrating the pivoted bracket in the extreme forward position.

DETAILED DESCRIPTION OF THE INVENTION

Figure 2:
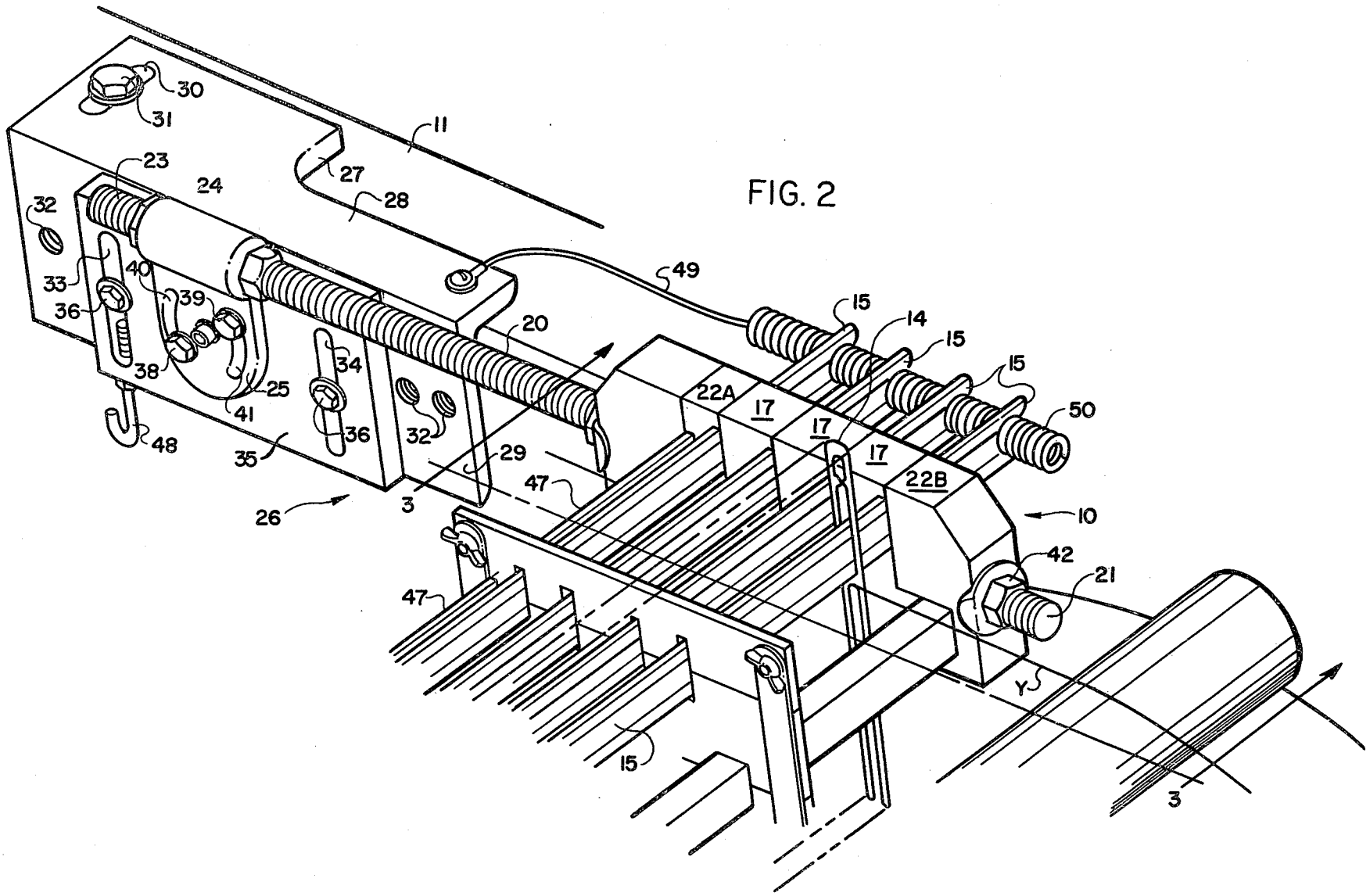
FIG. 2 is a perspective view, with parts broken away, illustrating the attachment of the stop-motion mechanism to one side of the frame of a loom.

Referring more specifically to the drawings, the stop-motion mechanism with which the present invention is associated is broadly indicated at 10. As most clearly seen in FIG. 1, the stop-motion mechanism 10 is fixed to the frame 11 at the rear of a loom adjacent a warp beam 12 and a whip roll 13. Individual ends of warp yarn, only one of which is indicated at Y for purposes of illustration, are drawn from the warp beam 12, across the whip roll 13 and through the stop-motion mechanism 10 enroute to the weaving instrumentalities, not shown, on the loom.

The stop-motion mechanism 10 includes a drop wire 14 for each warp yearn Y supported about electrodes 15 and between separator bars 16. The electrodes 15 and separator bars 16 extend transversely across the rear of the loom and are supported between spacer blocks 17, there being a block 17 of desired thickness between adjacent electrodes 15 and separator bars 16 (FIG. 3) to maintain them in desired spaced relation. A threaded rod 20 having a free end 21 extends loosely through a corresponding opening in each block 17 preparatory to clamping the electrodes 15 and separator bars 16 between the blocks 17. End blocks 22 are also loosely mounted on the threaded rods 20 to support the outermost and innermost electrodes and separator bars. One of the threaded rods 20 is provided at each side of the loom and each threaded rod 20 includes a fixed end portion 23 adjustably journaled in a tubular extension 24 of a pivot bracket 25.

It is to be understood that the rod 20, tubular extension 24 and pivot bracket 25 are components of a support assembly broadly indicated at 26 and that there is a support assembly 26 of the same construction on each side of the loom 10 and that the following description of the support assembly 26 illustrated in the drawings on one side of the loom is equally applicable to the support assembly on the other side of the loom.

Figure 5:
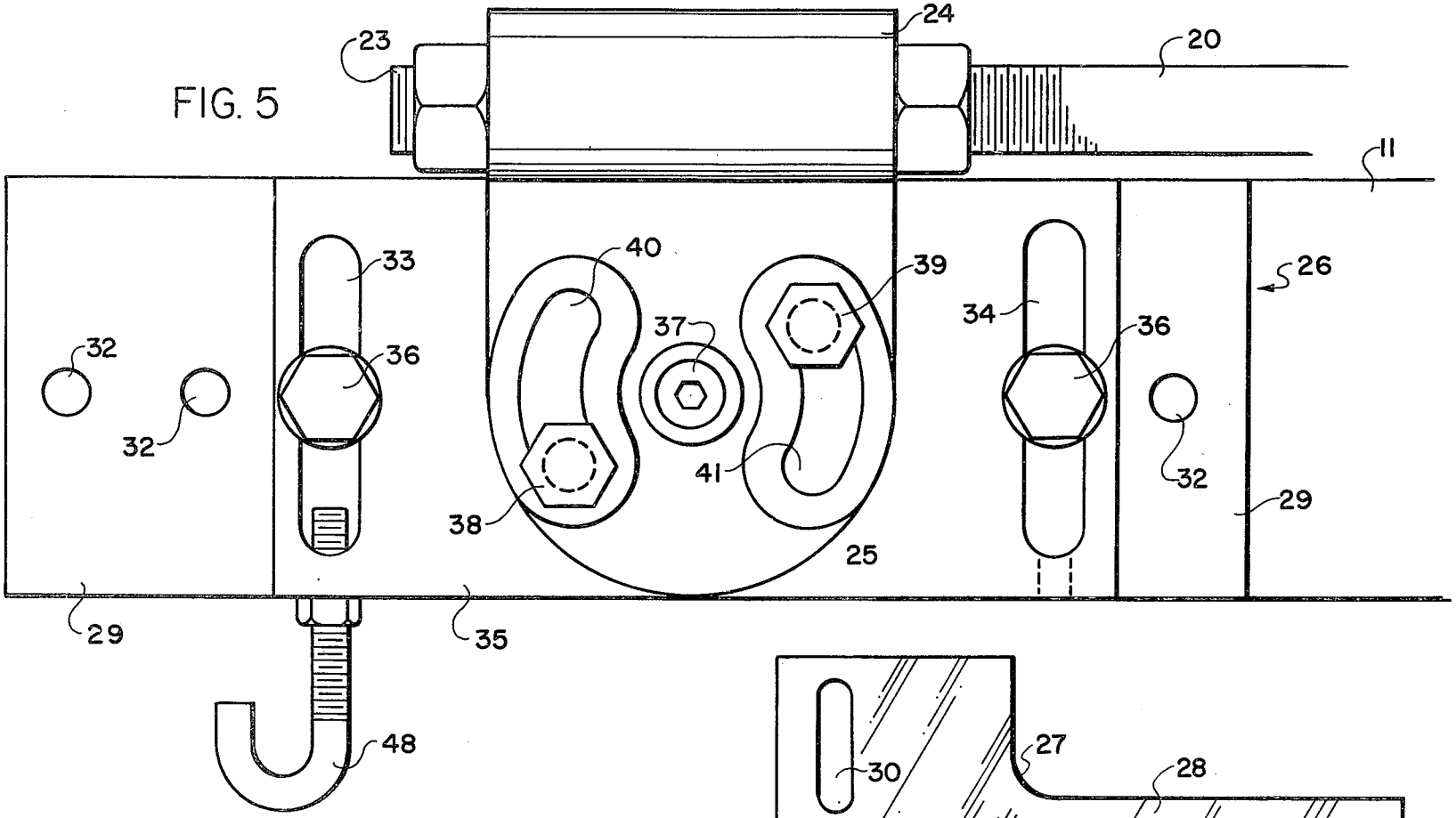
FIG. 5 is an enlarged side view of one of the mounting brackets for supporting the stop-motion mechanism and illustrating the pivoted bracket in lowered operative position.
Figure 8:
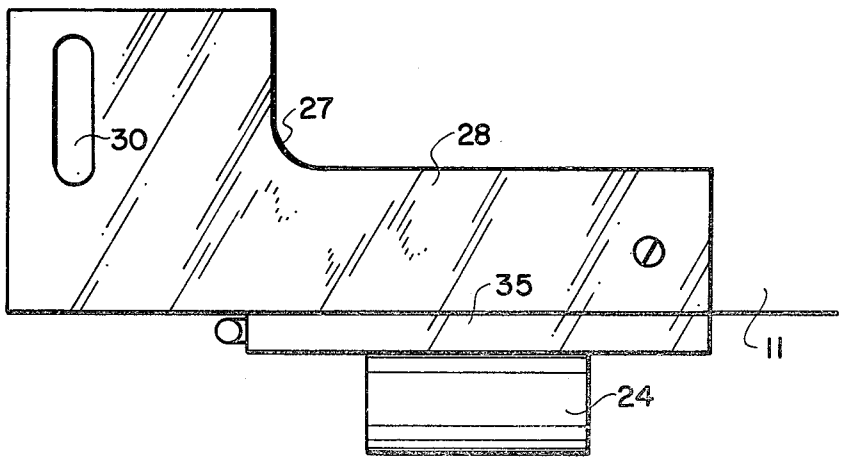
Figure 8 is a view similar to FIG. 7 but illustrating the pivoted bracket in the extreme rear position.

The support assembly 26 for the stop-motion mechanism 10 comprises an L-shaped angle bracket 27 including a horizontally disposed plate 28 and a vertically disposed plate 29. The horizontal plate 28 has a transversely extending slot 30 through which a bolt 31 loosely passes and is secured to the frame 11 of the loom. The vertical plate 29 of bracket 27 has a row of longitudinally extending equally spaced threaded bores 32, two of which are selectively registrable with vertically extending slots 33 and 34 in a mounting plate 35. In the illustrated embodiment, there are nine holes 32 equally spaced along the length of the mounting plate 35. The mounting plate 35 is shorter than the bracket 29 and may be moved from its intermediate position on the bracket 29 as shown in FIG. 5 to its extreme forward position as shown in FIG. 7. Alternatively, plate 35 may be moved to its extreme rearward position as shown in FIG. 8 simply by repositioning the bolts 36 from the intermediate position shown in FIG. 5 to auxiliary threaded bores 32. The longitudinally spaced holes 32 which register with the vertical slots 33 and 34 in the mounting plate 35 readily enable the stop-motion mechanism 10 to be positioned closer or further from the loom heddles, as desired, depending on the type of fabric being formed and other consideration.

The pivot bracket 25 is pivotally journaled on the mounting plate 35 by a pivot pin 37 extending through the transverse axis of the pivot bracket 25. The pivot bracket 25 is freely pivotal about pin 37 relative to mounting plate 35, but may be supported in raised position by adjustment of bolts 38 and 39 which loosely penetrate arcuate slots 40 and 41 through pivot bracket 25 and are threadably retained in threaded bores, not shown, in the mounting plate 35.

The threaded bores in the mounting plate 35 which receive the bolts 38 and 39 are so located that the bolts 38 will engage the lower end wall of the arcuate slot 40 and the bolt 39 will engage the upper end wall of the arcuate slot 41 when the threaded shaft 20 and the attached stop-motion mechanism 10 are lowered to the operative position illustrated in FIGS. 2 and 5. Consequently, the end walls of the arcuate slots 40, 41 provide a positive stop which automatically positions the stop-motion mechanism 10 in operative position without the need for manual adjustment.

Figure 6:
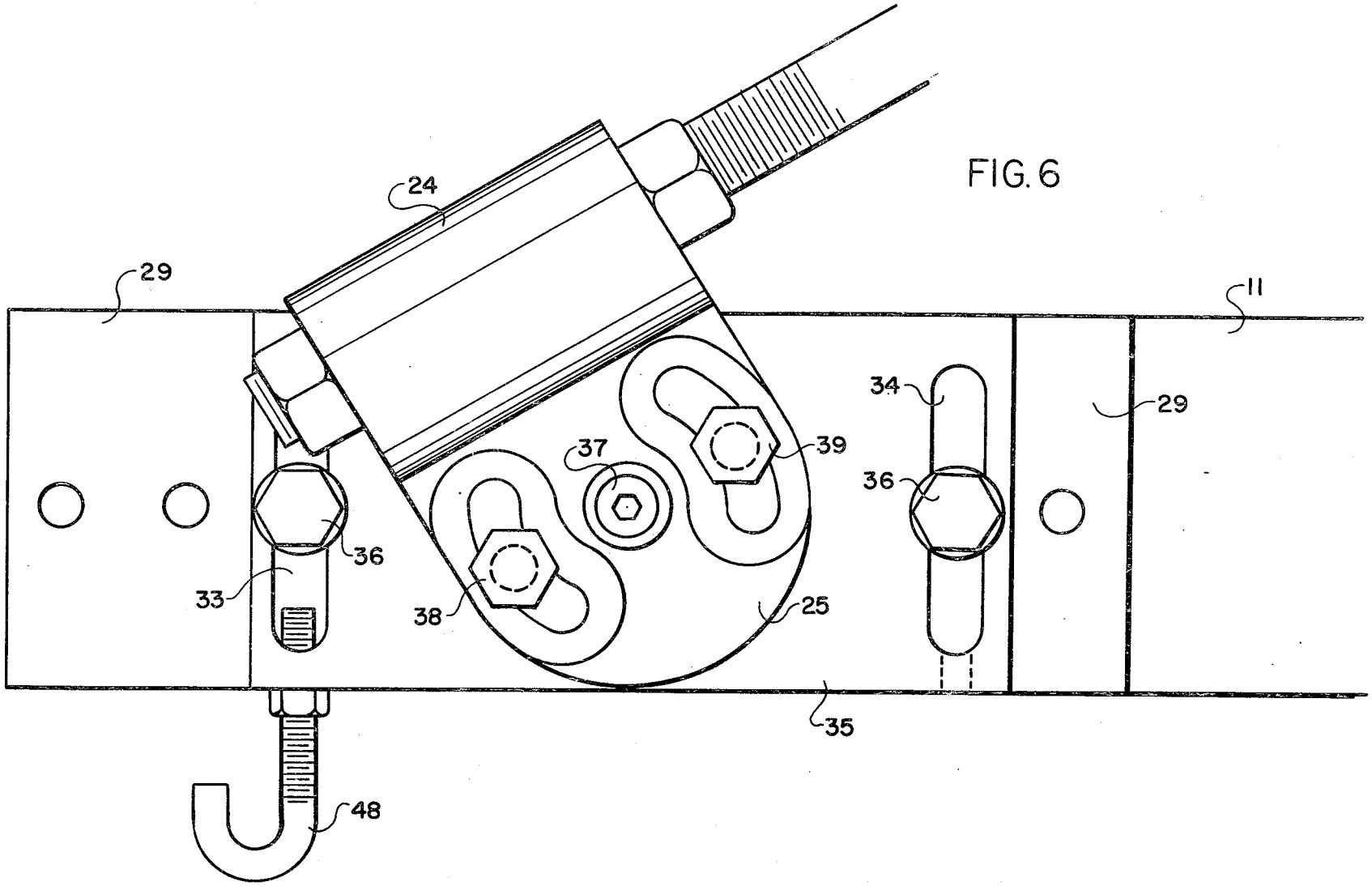
FIG. 6 is a view similar to FIG. 5 but showing the pivoted bracket in the raised or inoperative position.

Similarly, when the bolts 38 and 39 are loosened as when it is desired to raise the stop-motion mechanism out of the way while changing a warp beam, the end walls of the arcuate slots 40, 21 provide a positive stop when the bolts 38, 39 engage them after the stop-motion mechanism has been raised to the maximum height (FIG. 6). When it is desired to reposition the stop-motion mechanism 10 to its operative lowered position, the bolts 38, 39 are loosened to permit the pivot bracket 25 to rotate to the right in FIG. 6 until the bolts 38, 39 engage, respectively, the lower end wall and the upper end wall of respective arcuate brackets 40 and 41. The rod 20 is then automatically returned to the horizontal position shown in FIG. 5 and the attached stop-motion mechanism 10 is properly positioned for operation.

The threaded rods 20 permit an infinite adjustment of the stop-motion mechanism longitudinally of the loom, but experience has shown that the length of the rod becomes excessive to the point where the assembly lacks stability if the rods 20 are made long enough to accomodate the parameters of desirable adjustment. According to the present invention, it is possible to shorten the rods 20 to a workable and more stable length and still obtain maximum longitudinal adjustment by use of the auxiliary mounting holes 32 through the vertical wall 29 of the L-shaped mounting bracket 27. By positioning the bolts 36 in desired threaded bores 32, the entire assembly may be moved longitudinally of the loom in increments equal to the spacing of the holes 32 which, in the preferred embodiment is about one (1) inch. Manipulation of the threaded rods 20 permits infinite longitudinal adjustment to be made within the one inch increment provided by the holes 32.

Figure 3:
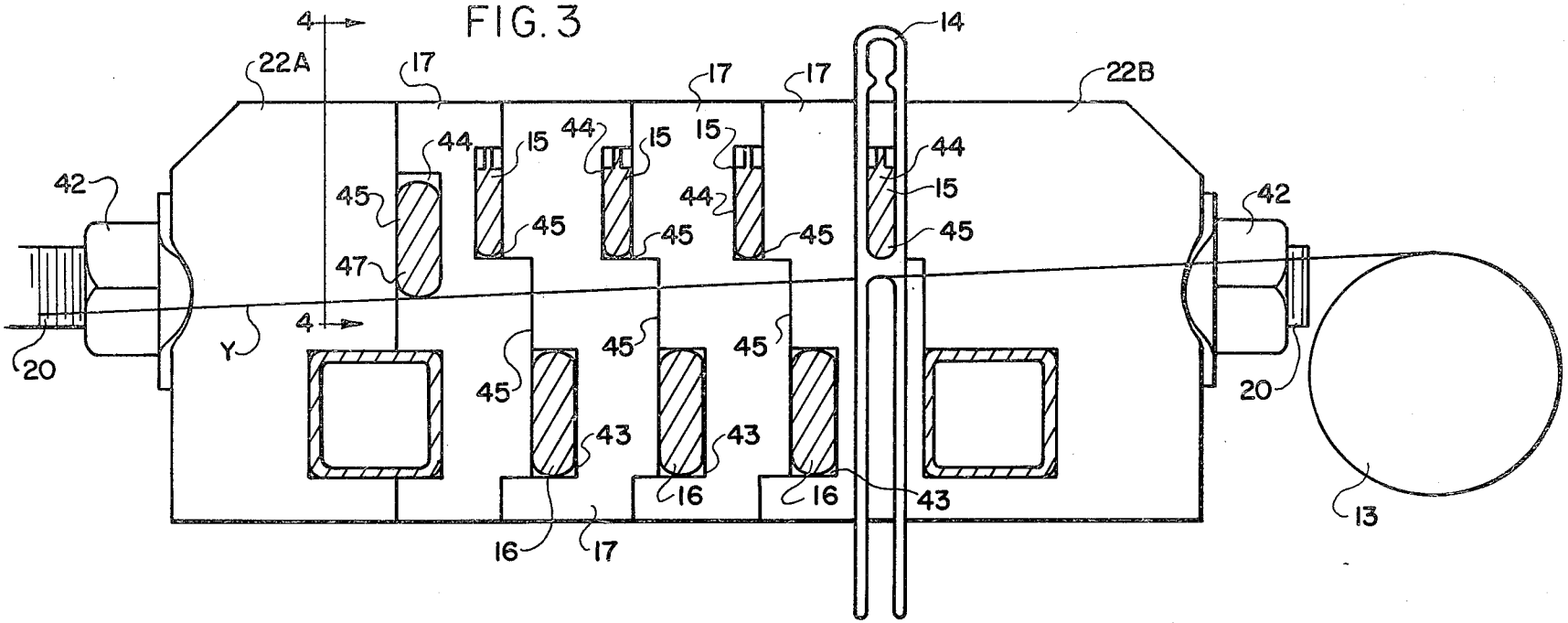
FIG. 3 is a sectional view of the electrodes, separator bars and spacer blocks taken substantially along the Line 3—3 in FIG. 2.

Referring to FIGS. 2 and 3, each of the spacer blocks 17 is shaped to snugly clamp the electrodes 15 and separator bar 16 when the end members 22 are moved toward each other by manipulation of the nuts 42 adjacent the innermost and outermost end pieces 22 in FIGS. 2 and 3. Specifically, the spacer blocks 17 and the end blocks 22 are each shaped to define chambers for the reception of the electrodes 15 and separator bars 16. As most clearly seen in FIG. 3, each block 17 has a chamber 43 in its lower portion of slightly less width than the thickness of the separator bar 16 received in each chamber 43. A chamber 44 is provided in the upper portion of each separator bar to receive an electrode 15. The width of the chamber 44 is also slightly less than the thickness of the electrode 15.

The electrodes 15 and separator bars 16 each protrude slightly beyond their respective chambers 43 and 44 to bear against a straight wall 45 of an adjoining spacer block 17. Arranged in this manner, the electrodes 15 and separator bars 16 are held rigidly in place when the nuts 42 on the threaded bars 20 are tightened to press the blocks 17 and 22 tightly against the electrodes 15 and separator bars 16. Rigidity of the structure is enhanced by the provision of heavy duty rectangular separator bars 46 retained by the end blocks 22A and 22B, and this rigid clamping practically eliminates wear of the electrodes which normally occurs due to loom vibration.

The electrodes in prior art stop-motion mechanisms are subject to additional wear by repeated impact of the warp yarns against the electrodes caused by the vertical reciprocation imparted to the warp yarns by the heddles. A control bar 47 is included in the stop-motion mechanism to prevent engagement of the warp yarns Y with the electrodes 15 and eliminate the wear on the electrodes previously caused by repeated contact of the drop wires with the electrodes.

Figure 4:
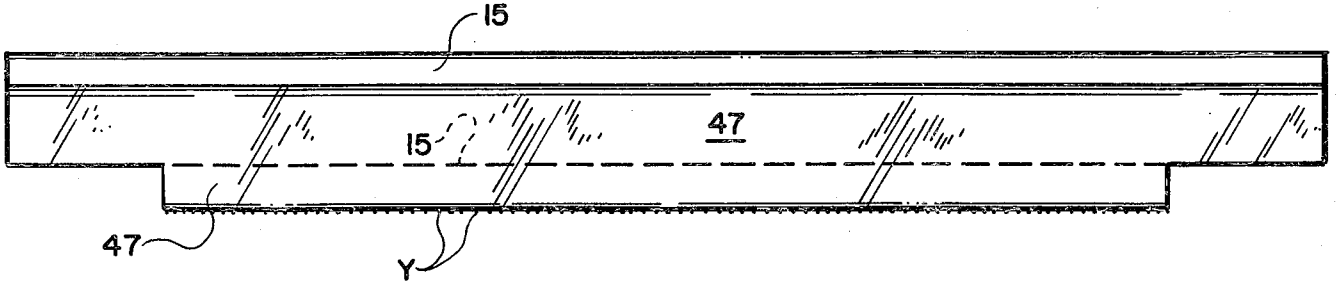
FIG. 4 is a sectional view taken substantially along the Line 4—4 in FIG. 3 but omitting the spacer blocks for purposes of illustration.

As most clearly seen in FIG. 3, the control bar 47 is tightly supported in a chamber 44 in the spacer block 17 adjoining the innermost end block 22A. It will be observed in FIG. 3 that the control bar 47 terminates in a horizontal plane spaced below the electrodes 15 supported between the spacer blocks 17. The warp yarns Y pass from the whip roll 13 beneath the electrodes 15 and above the separator bars 16 to engagement with the control bar 47 as most clearly seen in FIGS. 3 and 4. The yarns Y remain in engagement with the control bar 45 during vertical reciprocation of the warp yarns by the heddles during operation of the loom, and are supported out of engagement with the electrodes at all times. Wear and tear on the electrodes and the warp yarns is correspondingly reduced.

A hook 48 depends from the mounting plate 35 to support a curtain, not shown, when the stop-motion mechanism is used with a water-pik loom.

The electrodes 15 are electrically connected to a source of electricity and grounded by wires 49 connected to springs 50 which easily and conveniently fit into notches in the ends of the electrodes 15.

There is thus provided a support assembly for an electric stop-motion mechanism of a weaving loom, which support assembly includes means protecting the electrodes from impingement by the warp yarns and comprises means for adjusting the mechanism transversly and vertically and improved means for adjusting the mechanism longitudinally to achieve the optimum operating position. Improved means are also provided for quickly pivoting the stop-motion mechanism out of the way when desired to perform routine or repair operations on the loom without disturbing the warp yarns in the drop wires, and for automatically repositioning the stop-motion assembly at its said predetermined optimum operating position without further attention from the operator.

Although specific terms have been used in describing the invention, they are used in a descriptive sense only and not for purposes of limitation.

I claim:

1. A pivotal warp stop-motion mechanism comprising an L-shaped mounting bracket including a horizontal plate and a vertical plate for attachment to the frame of a loom having heddles and a warp beam with warp yarns extending therefrom and through the heddles, a plurality of threaded bores extending transversely therethrough and arranged in equally spaced relation to each other in a row extending parallel to the longitudinal axis of the mounting bracket, a mounting plate having a pair of vertically extending slots spaced from each other a distance less than the length of the row of threaded openings and registrable with a selected pair of threaded openings, bolts loosely penetrating the vertical slots in the mounting plate and threadably engagable with the threaded openings in the vertical portion of the mounting bracket, a pivot plate pivotally connected at its axis to the mounting plate, said pivot plate having a vertically extending slot of arcuate configuration on each side of the pivotal connection, a tubular extension of the pivot bracket extending above the pivotal connection, a threaded rod loosely receivable through the tubular extension, the threaded rod having a fixed end adjacent the tubular extension and a free end portion spaced further from the tubular extension and supporting the warp stop-motion mechanism, the warp stop-motion mechanism including spacer blocks threaded on the threaded rod on each side of the loom, a plurality of electrodes supported by the spacer blocks and having lower edges lying in a common plane, a drop wire supported by each warp yarn about one of said electrodes and a control bar having a lower edge lying in a horizontal plane beneath the plane occupied by the lower edges of the electrodes and clamped by spacers on the threaded rod between the electrodes and the heddles, and said mounting plate having a first threaded bore adjacent the upper end of the arcuate slot closest to the warp beam when the stop-motion mechanism is in its lowered operative position, said mounting plate having a second threaded bore adjacent the lower end of the arcuate slot closest to the heddles when the stop-motion mechanism is in its lowered operative position, and threaded bolts extending loosely through the arcuate slots and threadably engagable with the first and second threaded openings in the mounting plate to form stops for automatically positioning the stop-motion mechanism at its desired operative position when lowered and to its maximum elevated position when raised.

2. Means comprising a unitary member for attaching a warp stop-motion mechanism having electrodes and drop wires to a loom having a frame, a warp beam and heddles, said member including first means for horizontally adjusting the location of the warp stop-motion mechanism between the warp beam and the heddles, second means for transversely adjusting the position of the warp stop-motion mechanism between the sides of the loom, third means for adjusting the vertical displacement of the warp stop-motion mechanism, at least certain of said first second and third means being connected directly to the loom frame, and means preventing warp yarn engagement with the electrodes.

3. A structure according to claim 2 wherein said first and second means are each connected directly to the loom frame.

4. A structure according to claim 3 wherein said means preventing warp yarn engagement with the electrodes comprises a control bar supported by the stop-motion mechanism between the electrodes and the heddles and in spaced parallel relation to the electrodes, and said control bar including a lower edge occupying a horizontal plane beneath the electrodes and engaging the warp yarns during normal operation of the loom.

5. A structure according to claim 2 wherein said means preventing warp yarn engagement with the electrodes comprises a control bar supported by the stop-motion mechanism between the electrodes and the heddles, said control bar extending in spaced parallel relation to the electrodes, and said control bar including a lower edge occupying a horizontal plane beneath the electrodes and engaging the warp yarns during normal operation of the loom.

* * * * *